US010575605B2

(12) United States Patent
Choi

(10) Patent No.: US 10,575,605 B2
(45) Date of Patent: Mar. 3, 2020

(54) JEWELRY STONES SET WITH PRONGS AND INVISIBLE SETTINGS

(71) Applicant: F.D. Worldwide Merchandise Group, Inc., New York, NY (US)

(72) Inventor: Sheung S. Choi, Roslyn, NY (US)

( * ) Notice: Subject to any disclaimer, the term of this patent is extended or adjusted under 35 U.S.C. 154(b) by 0 days.

(21) Appl. No.: 15/467,890

(22) Filed: Mar. 23, 2017

(65) Prior Publication Data

US 2017/0188670 A1 Jul. 6, 2017

Related U.S. Application Data

(63) Continuation-in-part of application No. 14/635,328, filed on Mar. 2, 2015, now Pat. No. 9,913,514, which is a continuation of application No. 12/661,051, filed on Mar. 9, 2010, now Pat. No. 8,966,938.

(51) Int. Cl.
*A44C 17/02* (2006.01)
*A44C 9/00* (2006.01)

(52) U.S. Cl.
CPC ..... *A44C 17/02* (2013.01); *A44C 9/00* (2013.01)

(58) Field of Classification Search
CPC ..... A44C 17/02; A44C 9/00
USPC ..... 63/15, 26–28
See application file for complete search history.

(56) References Cited

U.S. PATENT DOCUMENTS 677,075 A * 6/1901 Fuchs ..... A44C 17/02 63/28
6,293,129 B1 * 9/2001 Gurevich ..... A44C 17/005 63/26
2009/0090132 A1 * 4/2009 Dholakiya ..... A44C 17/00 63/12

* cited by examiner

*Primary Examiner* — Jack W Lavinder
(74) *Attorney, Agent, or Firm* — Stephen E. Feldman; Feldman Law Group, P.C.

(57) ABSTRACT

A jewelry setting having a structure, the structure having an outer circumference in a round shape and setting four princess-cut stones and at least eight stones of a different cut, the structure including an invisible setting located at a center of the structure, the invisible setting partially mounting the four princess-cut stones, the four princess-cut stones being surrounded by the at least eight stones of a different cut, the eight stones of a different cut being set using prong settings, the four princess-cut stones and the at least eight stones of a different cut being arranged so that the four princess-cut stones and the at least eight stones appear to be a continuous, uninterrupted surface thus creating an illusion of a large stone in the round shape; and a ring structure attached to the structure.

1 Claim, 21 Drawing Sheets

JEWELRY STONES SET WITH PRONGS AND INVISIBLE SETTINGS

CROSS-REFERENCE TO RELATED APPLICATION

This application is a continuation in part of U.S. patent application Ser. No. 14/635,328, filed on Mar. 2, 2015, which is a continuation of U.S. patent application Ser. No. 12/661,051, filed on Mar. 9, 2010, now U.S. Pat. No. 8,966,938, issued Mar. 3, 2015, which patent applications are incorporated here by reference in their entirety to provide continuity of disclosure.

FIELD OF THE INVENTION

The disclosed technology relates to setting jewelry stones with prongs and invisible settings and, more particularly, to a jewelry stone setting adapted to help enhance brilliance, sparkle and apparent size of a plurality of jewelry stones on a single setting.

BACKGROUND

The jewelry settings are normally provided with prongs that are widely used in the art to hold the diamonds within the settings. For example, U.S. Pat. No. D 315,698 shows a setting wherein the princess-cut diamond is held in place by the use of plurality of prongs. Moreover, the use of prong settings for setting multiple stones for creating an illusion of a big diamond is seen in prior art U.S. Pub. Nos. 2005/0144980 and 2007/0234758. However, the diamonds of these settings frequently come out as they undergo physical deterioration due to their outward configuration and orientation. In addition, the jewelry prongs are normally positioned over the upper surfaces of the diamonds and are especially adapted to at least partially enclose the upper surface of the diamonds that reduces the aesthetic effect of the diamonds as well.

The use of invisible mounting techniques to overcome the problems associated with the prong settings is well known in the art, wherein the diamonds are mounted on the settings without the use of the prongs. One such example of the mounting technique is channel setting. For example, U.S. Pub. No. 2008/0053148 shows one such setting that provides an invisible or mysterious setting system that has the particular feature of allowing several round precious stones of predefined shape to be assembled around a central round precious stone in such a way as entirely to eliminate grooves on the table side of the precious stones to result is an attractive appearance which gives the illusion of one large round precious stone when the stone is viewed from the table side. Moreover, U.S. Pat. No. 6,550,275 discloses a round gemstone setting with convexly configured gemstones that are set in flush, surface to surface mating relation. However, designing of the invisible settings using single shaped diamond can be a very difficult task especially for relatively larger and complex shaped diamonds, such as Marquise or Pear shaped diamonds. Such settings need substantial designing efforts from the designer/artisan with single shaped/cut diamonds and unnecessarily increase the effective cost of the jewelry article. Hence, the utilization of multi-shaped diamonds for forming marquise or pear shaped composite Diamond Head is needed.

There are few attempts seen in the art to Use a plurality smaller diamonds to form a composite Diamond Head in order to reduce the effective cost and efforts being utilized.

One such head can be seen in the, prior art U.S. Pub. No. 2005/0188722 that discloses an exemplary system and method for providing a jewelry setting is disclosed that comprises a first gemstone in an array of gemstones generally retained at a girdle by fasteners that hold the a plurality of gemstones surrounding the first gemstone. Also, the prior art patent D 505,092 teaches an ornamental design for a diamond setting wherein the setting comprises total eleven diamonds that all are of round shape. However, the settings in the art have substantially failed to use multi-shaped diamonds/stones as the diamonds from the settings are generally of single shape. Hence, the utilization of multi-shaped diamonds such as, for example, smaller round, medium round, large round, princess and baguette stones to form a composite diamond head is needed.

SUMMARY OF THE INVENTION

In one implementation, a jewelry setting comprising: a structure, the structure having an outer circumference in a round shape and setting four princess-cut stones and at least eight stories of a different cut, the structure including an invisible setting located at a center of the structure, the invisible setting partially mounting the tour princess-cut stones, the four princess-cut stones being surrounded by the at least eight stones of a different cut, the eight stones of a different cut being set using prong settings, the four princess-cut stones and the at least eight stones of a different cut being arranged so that the four princess-cut stones and the at least eight stones appear to be a continuous, uninterrupted surface thus creating an illusion of a large stone in the round shape; and a ring structure attached to the structure.

In some implementations, the at least eight stones of a different cut are round cut stones. In some implementations, the round cut stones are set using a first set of prongs and a second set of prongs, the first set of prongs being located adjacent to an outer circumference of the structure, the second set of prongs being located adjacent to an outer perimeter of the four princess-cut stones, the first set of prongs being larger than the second set of prongs. In some implementations, the four princess-cut stones are set with the invisible setting and the second set of prongs. In some implementations, the round cut stones are set using a first set of prongs, a second set of prongs and a third set of prongs, wherein the third set of prongs are tear drop prongs and the first set of prongs being larger than the second set of prongs. In some implementations, the four princess cut stones are set with the invisible setting, the second set of prongs and the third set of prongs. In some implementations, the at least eight stones of a different cut are four round-cut stones and four emerald cut stones. In some implementations, the round cut stones are set using one large and three small prongs and the emeralds cut stones are set using three small prongs. In some implementations, the four princess cut stones are set with the invisible setting and the four large prongs.

In another implementation, a jewelry setting comprising: a structure, the structure having an outer circumference in a square shape and setting four princess-cut stones and at least eight stones of a different cut, the structure including an invisible setting located at a center of the structure, the invisible setting partially mounting the four princess-cut stones, the four princess-cut stones being surrounded by the at least eight stones of a different cut, the eight stones being set using prong settings, the four princess-cut stones and the at least eight stones arranged in such a way that the stones and appear to be a continuous, uninterrupted surface thereby creating an illusion of a large stone in the square shape. In some implementations, the at least eight stones of a different cut are round cut stones. In some implementations, the eight round cut stones are set using an outer set of prongs and an inner set of prongs. In some implementations, the four princess cut stones are set with the invisible setting and the inner set of prongs. In some implementations, the four round cut stones are set using one large prong and three small prongs and four round cut stones are set using four small prongs. In some implementations, the four princess cut stones are set with the invisible setting and the eight small prongs.

BRIEF DESCRIPTION OF DRAWINGS

The above mentioned and other features, aspects and advantages of the present invention will become better understood with regard to following description, appended claims and accompanying drawings, wherein like reference numerals refer to similar parts throughout the several views where:

DETAILED DESCRIPTION

Figure 1:
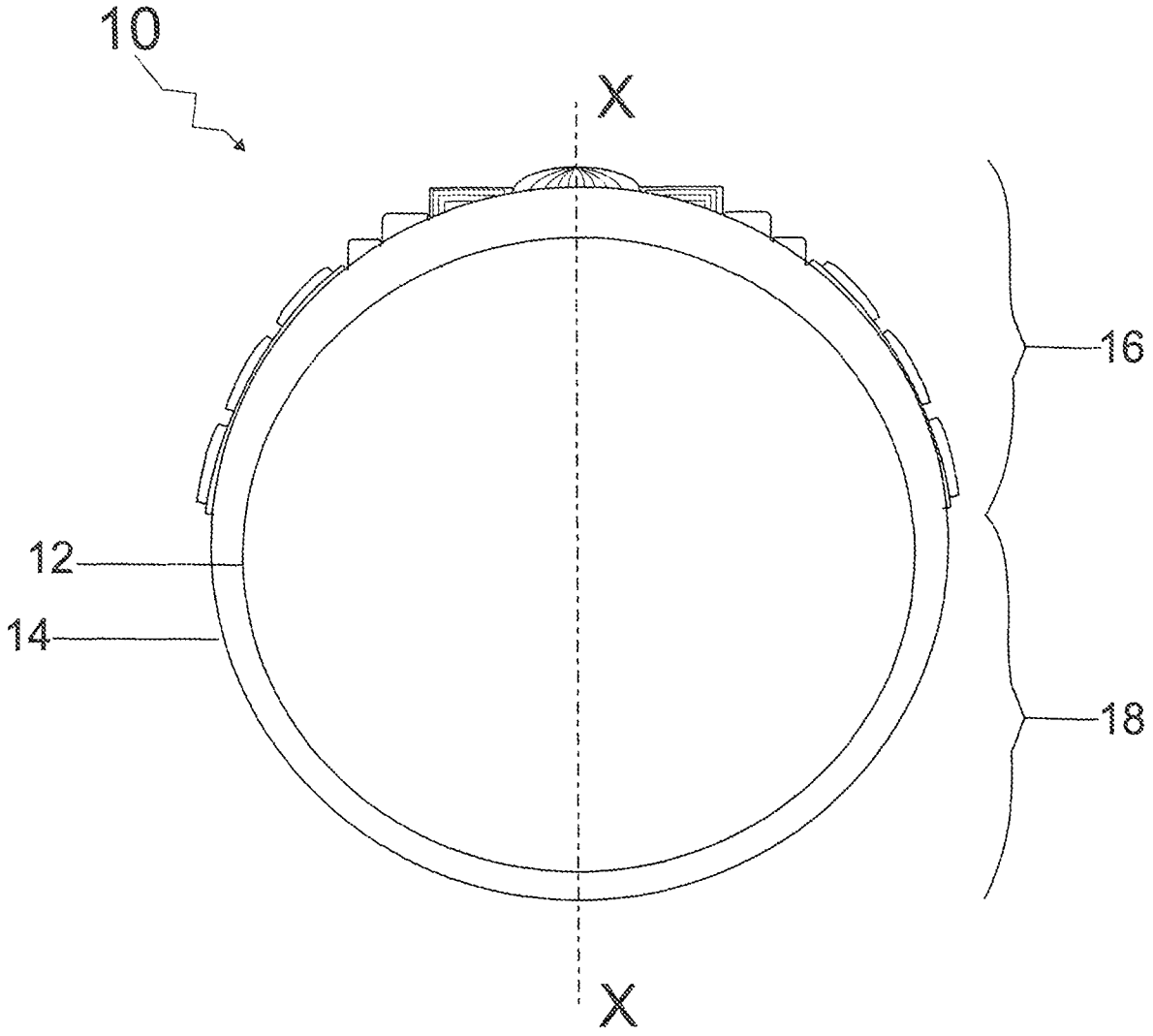
FIG. 1 is a front view of a ring with a first preferred embodiment of a composite diamond head ring setting constructed in accordance with the present invention.

Although specific terms are used in the following description for sake of clarity, these terms are intended to refer only to particular structure of the invention selected for illustration in the drawings, and are not intended to define or limit the scope of the invention.

Figure 2:
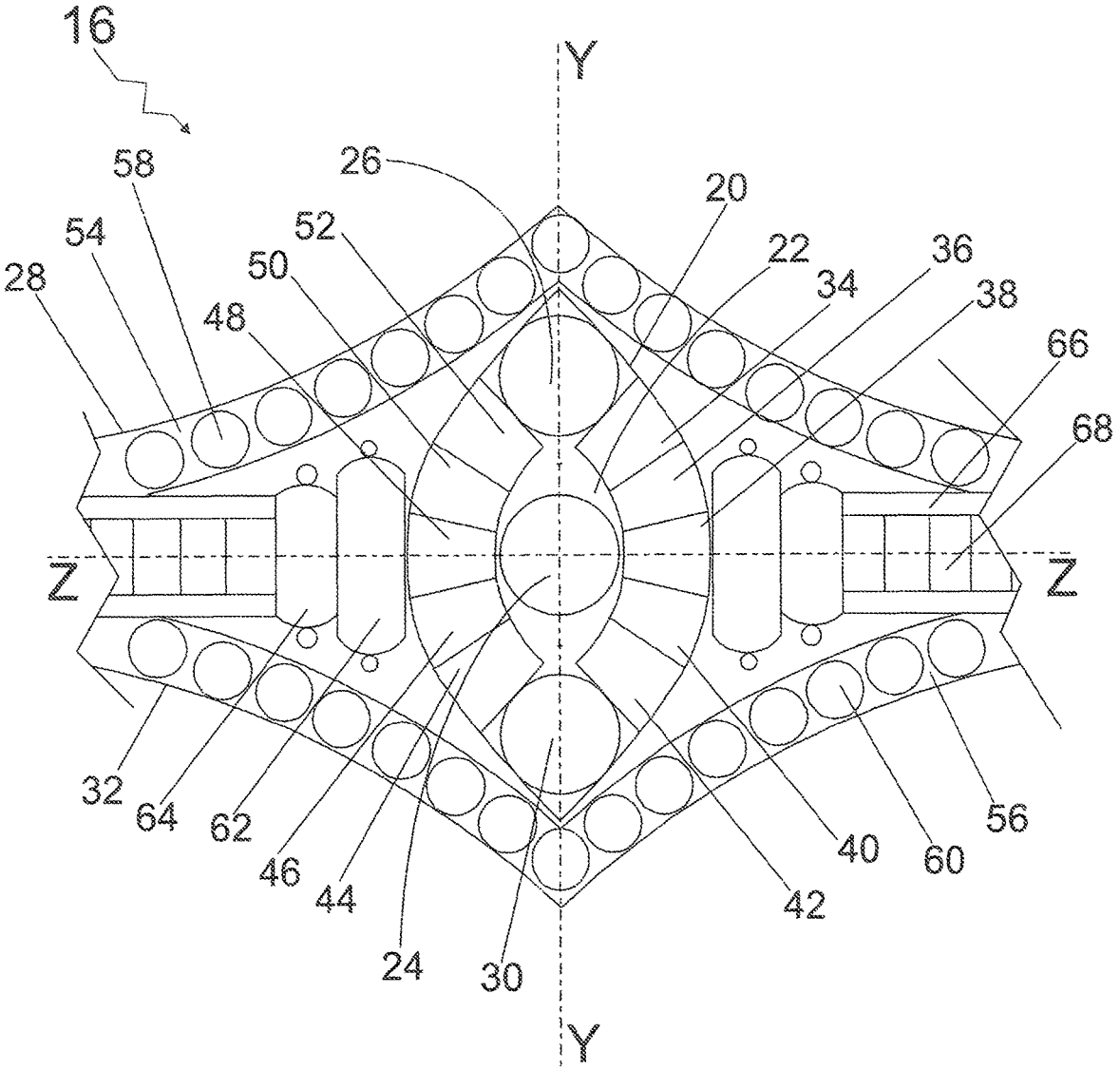
FIG. 2 is an enlarged top view of a bead portion of the ring setting of FIG. 1 showing a preferred embodiment of a channel structure.

Referring initially to FIGS. 1 and 2, a jewelry ring 10 is shown that includes an inner rim member 12 and an outer rim member 14 that are bilaterally positioned along a central vertical axis-X and preferably define a head portion 16 and base portion 18. In this one preferred embodiment, the rim members 12, 14 have an off-centered orientation along axis-X that facilitate head portion 16 to have a relatively larger thickness than base portion 18. However, it is understood that rim members 12, 14 can have a common-centered orientation in other alternative embodiments. The inner rim 12 defines a circular boundary of hollow space within ring 10 that is preferably adapted to define a finger size of ring 10.

Head portion 16 is preferably located over upper portion of outer rim 14 and extends over half of the perimeter of rim 14. Base portion 18 is preferably defined over lower portion of rim 14. It is understood here that the orientation of portions 16, 18 may substantially vary in other alternative embodiments. Head portion 16 defines at least one channel structure that includes at least one indentation adapted to be positioned with a plurality of multiple shaped diamonds in a juxtaposition arrangement to form a clustered Diamond Head that creates an illusion of a big diamond to a normal observer.

In this one preferred embodiment, head portion 16 includes a first channel structure 20 that has a Marquise shaped indentation 22 configured to include a plurality of round cut and baguette diamonds/stones in a perfectly flush arrangement through an invisible setting means. The invisible setting means mounts diamonds/stones within indentation 22 by remaining invisible to a normal observer. The invisible setting means is a metal structure concealed underneath the stones/diamonds to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

First channel structure 20 has a center that is aligned along the central vertical axis-X that is positioned with a first round cut diamond 24. The channel structure 20 includes a second round cut diamond 26 that is positioned in the proximity of a first side edge 28 of structure 20. The channel structure 20 includes a third round cut diamond 30 that is positioned in the proximity of a second side edge 32 of structure 20. Diamonds/stones 24, 26 and 30 have their centers aligned along a single horizontal axis-Y that is substantially perpendicular to the central vertical axis-X.

The channel structure 20 includes a plurality of baguette diamonds that are adapted to surround round cut diamonds 22, 24 and 30. In this one preferred embodiment, channel structure 20 includes a first baguette diamond 34, a second baguette diamond 36, a third baguette diamond 38, a fourth baguette diamond 40, a fifth baguette diamond 42, a sixth baguette diamond 44, a seventh baguette diamond 46, an eighth baguette diamond 48, a ninth baguette diamond 50 and a tenth baguette diamond 52 that are positioned in juxtaposition with each other. It is understood here that the quantity of baguette diamonds may vary in other alternative embodiments. The juxtaposition arrangement of round 3 cut diamonds 24, 26, 30 and baguette diamonds 34-52 altogether form a clustered head that creates an illusion of a big marquise shaped Diamond to the normal observer.

The head portion 16 includes a second channel structure 54 and a third channel structure 56 that are respectively aligned along first side edge 28 and second side edge 32. The channel structures 54 and 56 are respectively identically positioned on either sides of a central horizontal axis-Z that is substantially perpendicular to the axis-Y. The channel structures 54, 56 in this one preferred embodiment respectively define indentations that are respectively configured to be mounted with a respective row of round diamonds/stones 58, 60 using a setting, means. The diamonds 58, 60 are set in juxtaposition within respective indentations to represent a continuous uninterrupted diamond surface along edges 28, 32. The setting means in this one preferred embodiment is a bezel setting. However, it, is understood that other setting means such as burnish setting, flush setting and pave setting can he used in other alternative embodiments.

The head portion 16 includes a first pair of baguette diamonds/stones 62 and a second pair of baguette diamonds 64 that are bilaterally positioned along the axis-Y and preferably have their centers located on the central horizontal axis-Z. The stones 62, 64 are preferably positioned on head portion using a prong setting means wherein the prong setting includes at least four prongs to hold stones 62, 64 in place, however, it is understood that other setting means such as a bezel setting or pave setting means can be used in other alternative embodiments of ring 10.

The head portion in this one preferred embodiment also includes a pair of fourth channel structures 66 bilaterally positioned along the axis-Y. Each of the channel structures 66 preferably includes a continuous row of a plurality of baguette cut diamonds 68. The diamonds 68 preferably have their centers located along the central horizontal axis-Y. The diamonds 68 are arranged in juxtaposition to create an illusion of a continuous, uninterrupted surface along a center of head portion 16.

Figure 3:
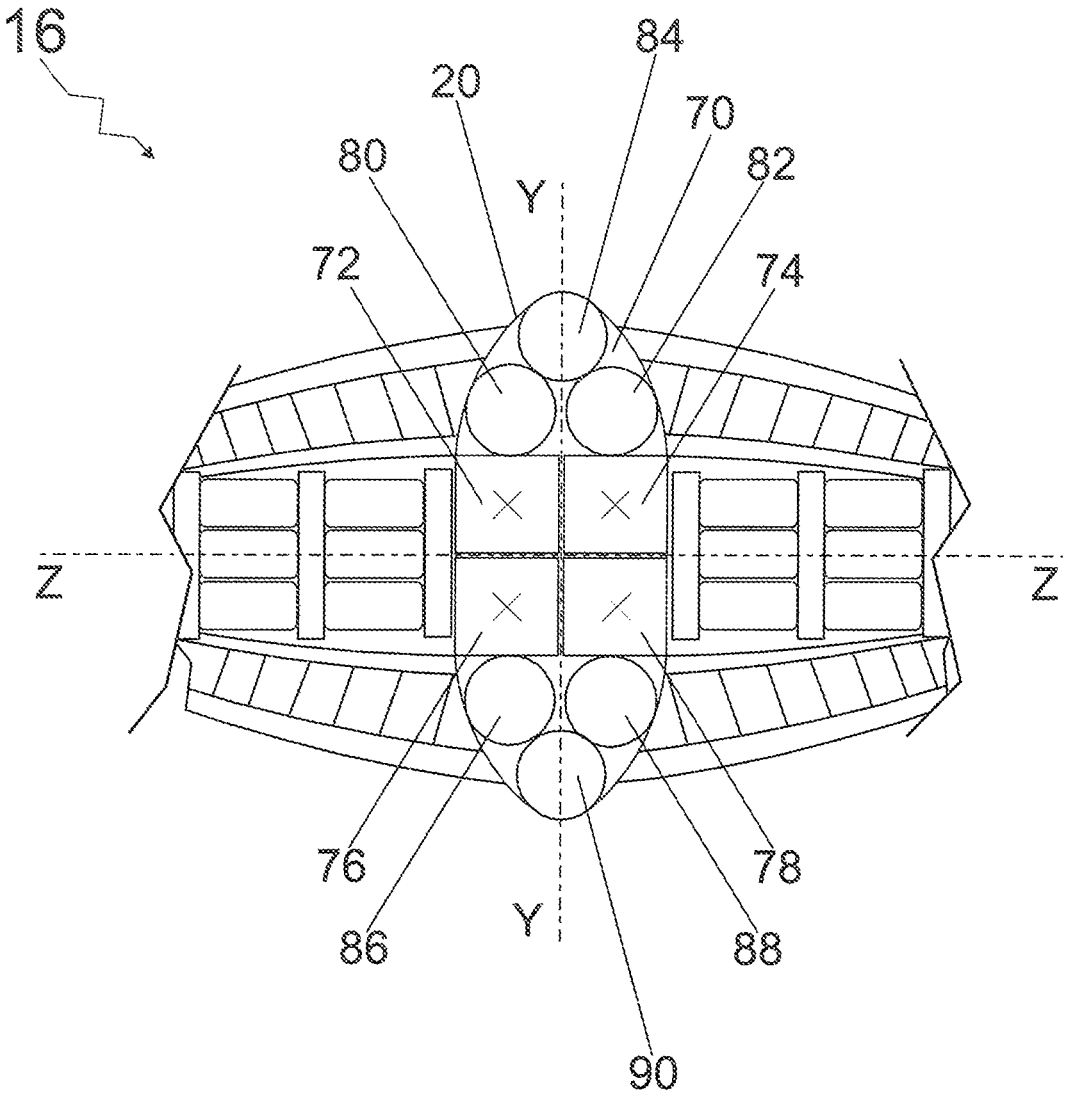
FIG. 3 is an enlarged top view of the head portion of the ring setting of FIG. 1 showing an alternative embodiment of the channel structure.

Referring to FIG. 3, an alternative embodiment of Marquise shaped composite head portion 16 is shown wherein first channeled structure 20 includes a Marquise shaped indentation 70 configured to include a plurality princess-cut and round-cut diamonds/stones in a perfectly flush arrangement against each other to compositely create a big illusion of a Marquise shaped diamond head. The stones/diamonds are mounted with an invisible settings means that is adapted to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

In this one alternative embodiment, indentation 70 includes a first princess-cut diamond 72, a second princess-cut diamond 74, a third princess-cut diamond 76 and a fourth princess-cut diamond 78. Diamonds 72, 74 are preferably located on one side of the axis-Z and diamonds 76, 78 are preferably located on the other side of the axis-Z. Diamonds 72, 76 are preferably located on, one side of the axis-X and diamonds 74, 78 are located on the other side of the axis-X. Indentation 70 also includes a first round diamond 80, a second round diamond 82, a third round diamond 84, a fourth round diamond 86, a fifth round diamond 88 and a sixth round diamond 90. The first round diamond 80 is positioned in juxtaposition with first princess diamond 72. The second round diamond 82 is positioned in juxtaposition with second princess diamond 74. The third round diamond 84 is positioned in juxtaposition with diamonds 80, 82 and preferably positions over an upper apex portion of Marquise shaped indentation 70. The fourth round diamond 86 is positioned in juxtaposition with third princess cut diamond 76. The fifth round diamond 88 is positioned in juxtaposition with fourth princess cut diamond 78. The sixth round diamond 90 is positioned in juxtaposition with diamonds 88, 90 and preferably positions over a lower apex portion of indentation 70. The juxtaposition arrangement of princess cut diamonds 72, 74, 76 and 78 and round diamonds 80, 82, 84, 86, 88, 90 altogether form a clustered composite head that creates an illusion of a big marquise shaped Diamond to the normal observer.

Figure 4:
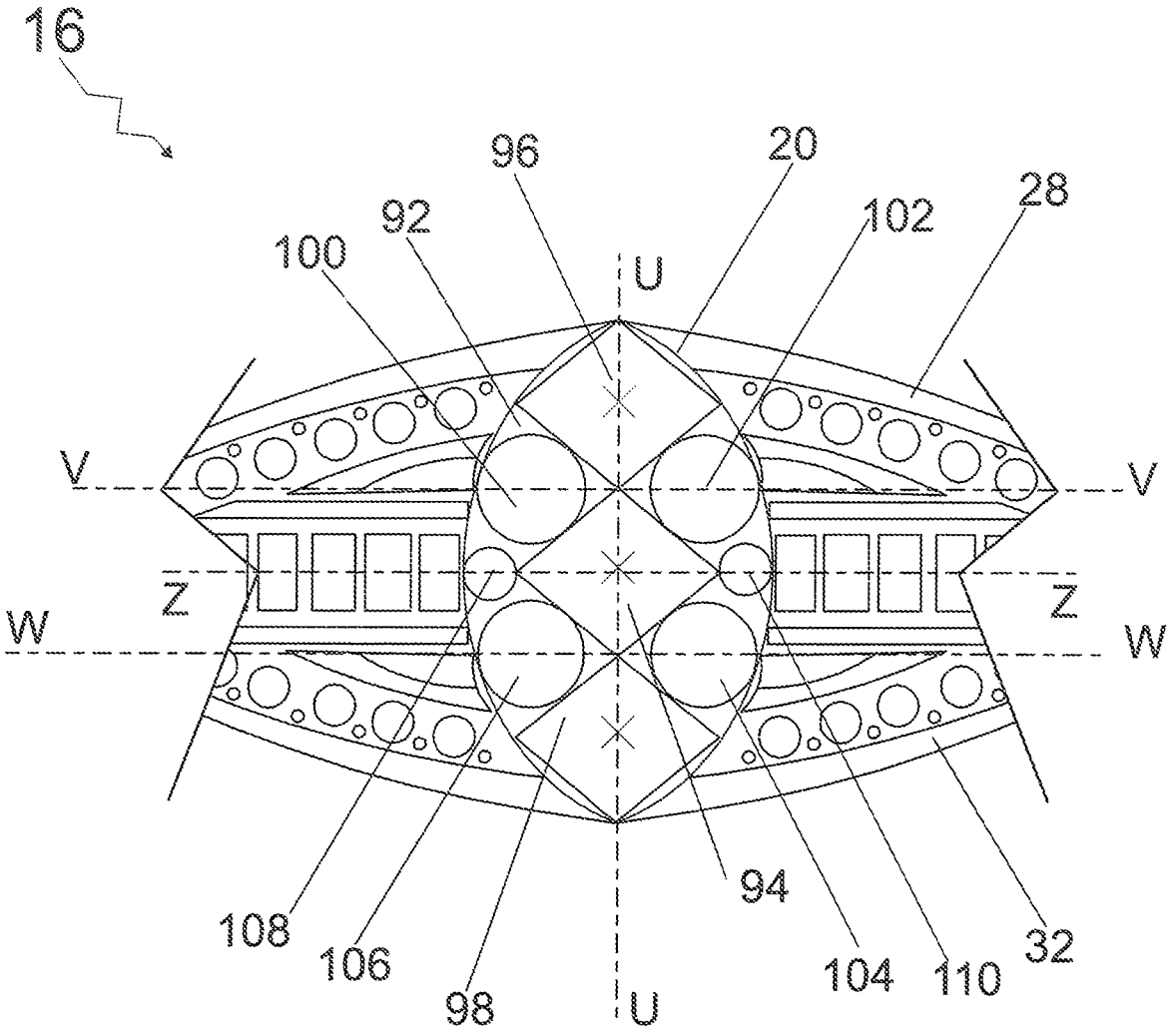
FIG. 4 is an enlarged top view of the head portion of the ring setting of FIG. 1 showing an alternative embodiment of the channel structure.

Referring to FIG. 4, an alternative embodiment of Marquise shaped composite head portion 16 is shown wherein first channeled structure 20 includes a Marquise shaped indentation 92 configured to include a plurality princess-cut, large round cut and small round-cut diamonds/stones in a perfectly flush arrangement against each other to compositely create a big illusion of a Marquise shaped diamond head. The stones/diamonds are mounted with an invisible settings means that is adapted to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

In this one alternative embodiment, first channel structure 20 has an indentation 92 that includes a first princess-cut diamond 94, a second princess-cut diamond 96, and a third princess-cut diamond 98. First princess-cut diamond 94 is positioned at a center of first channel structure 20 and is aligned along the central horizontal axis-Z. The second princess cut diamond 96 is positioned in the proximity of first side edge 28 of structure 20. The third princess cut diamond 98 is positioned in the proximity of second side edge 32 of structure 20. Diamonds/stones 94, 96 and 98 have their centers aligned along a single axis-W that is substantially perpendicular to the axis-Z.

The indentation 92 includes a first large round cut diamond 100, a second large round cut diamond 102, a third large round cut diamond 104 and a fourth large round cut diamond 106. The first and second round diamonds 100, 102 are preferably positioned along an axis-V that passes through an intersection surface of diamonds 94, 96. The third and fourth round diamonds 104, 106 are preferably positioned along an axis-W that passes through an intersection surface of diamonds 94, 98. The indentation 92 includes a first small round stone 108 and a second small round stone 110 that are substantially aligned along the axis-Z and preferably positioned along the corner points of first princess cut diamond 94.

Princess cut diamonds 94, 96, 98, four large round diamonds 100, 102, 104, 106 and small round cut diamonds 108, 110 altogether form a clustered composite head that creates an illusion of a big marquise shaped Diamond to the normal observer.

Figure 5:
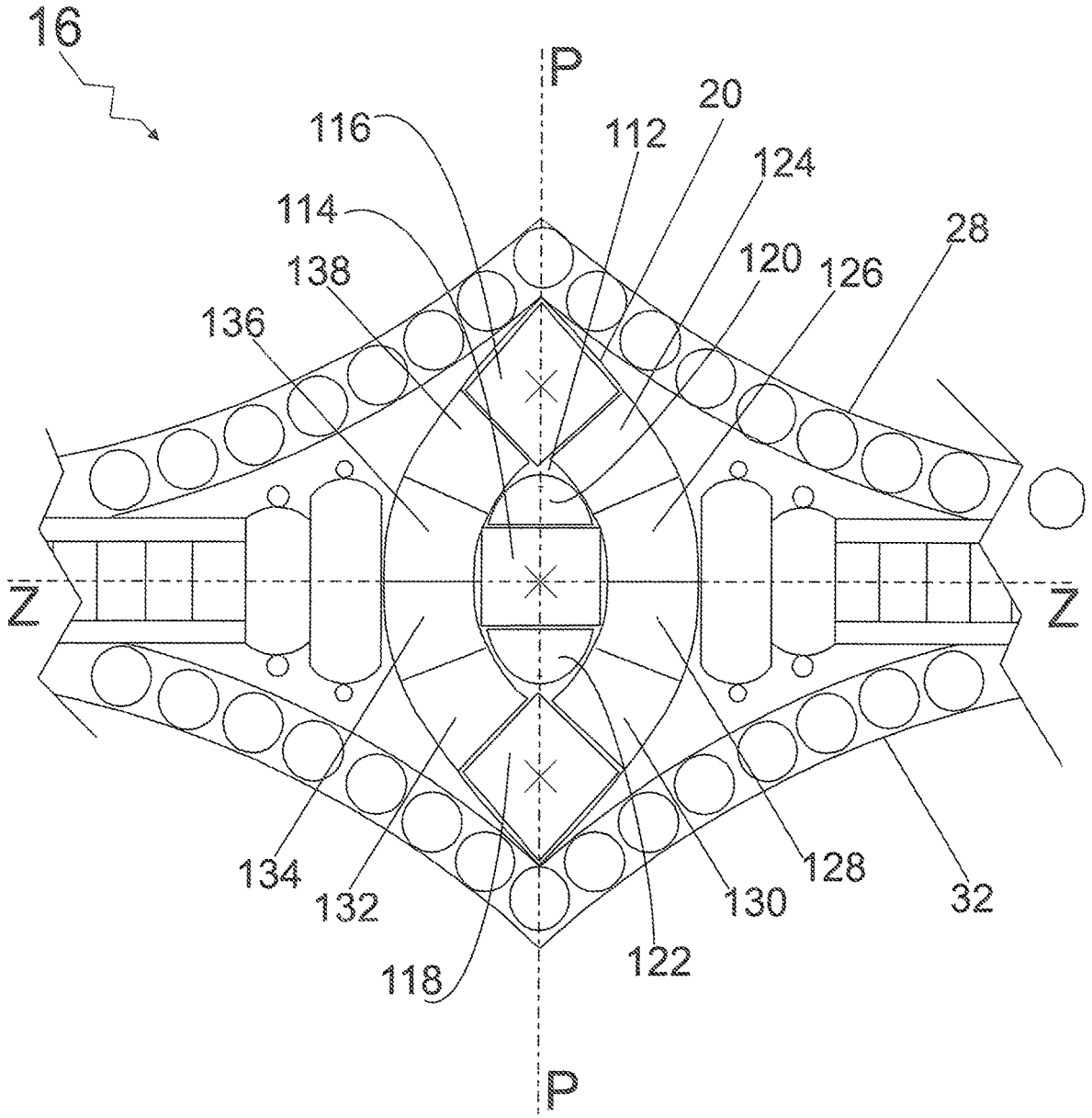
FIG. 5 is an enlarged top view of the head portion of the ring, setting of FIG. 1 showing an alternative embodiment of the channel structure.

Referring to FIG. 5, an alternative embodiment of Marquise shaped composite head portion 16 is shown wherein first channeled structure 20 includes a Marquise shaped indentation 112 configured to include a plurality princess-cut, baguette cut and half round-cut diamonds/stones in a perfectly flush arrangement against each other to compositely create a big illusion of a Marquise shaped diamond head. The stones/diamonds are mounted with an invisible settings means that is adapted to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

In this one alternative embodiment, indentation 112 of first channel structure 20 includes a first princess-cut diamond 114, a second princess-cut diamond 116, and a third princess-cut diamond 118. First princess-cut diamond 114 is positioned at a center of first channel structure 20 and is aligned along the central horizontal axis-Z. The second princess cut diamond 116 is positioned M the proximity of first side edge 28 of structure 20. The third princess cut diamond 118 is positioned in the proximity of second side edge 32 of structure 20. Diamonds/stones 114, 116 and 118 have their centers aligned along a single axis-P that is substantially perpendicular to the axis-Z.

The indentation 112 includes a first half round cut diamond 120, a second half round cut diamond 122. The first half round diamond 120 is preferably positioned between the first and second princess-cut diamonds 114, 116 along the axis-P. The second half round diamond 122 is preferably positioned between first and third princess-cut diamonds 114, 118 along the axis-P.

The indentation 112 includes a first baguette diamond 124, a second baguette diamond 126, a third baguette diamond 128, a fourth baguette diamond 130, a fifth baguette diamond 132, a sixth baguette diamond 134, a seventh baguette diamond 136, and an eighth baguette diamond 138 that are positioned in juxtaposition with each other and preferably surround the first princess cut stone 114 and half round stones 120, 122. It is understood here that the quantity of baguette diamonds may vary in other alternative embodiments.

The princess cut diamonds 114, 116, 118, the half round diamonds 120, 122 and the baguette diamonds 124-138 altogether form a clustered composite head that creates an illusion of a big marquise shaped Diamond to the normal observer.

Figure 6:
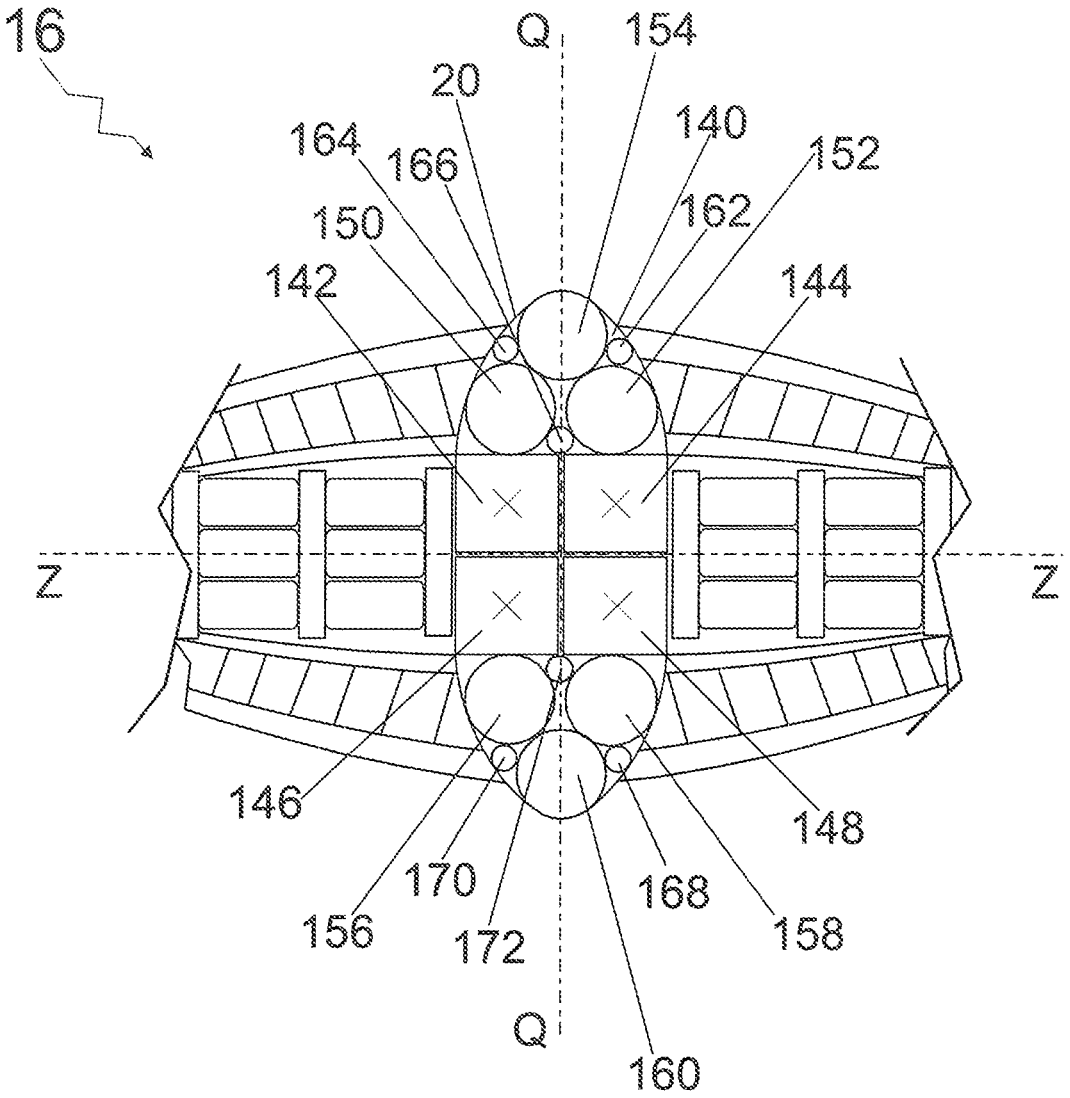
FIG. 6 is an enlarged top view of the head portion of the ring setting of FIG. 1 showing, an alternative embodiment of the channel structure.

Referring to FIG. 6, an alternative embodiment of Marquise shaped composite head portion 16 is shown wherein first channeled structure 20 includes a Marquise shaped indentation 140 configured to include a plurality princess-cut and round-cut diamonds/stones in a perfectly flush arrangement against each other to compositely create a big illusion of a Marquise shaped diamond head.

Indentation 140 includes a first princess-cut diamond 142, a second princess-cut diamond 144, a third princess-cut diamond 146 and a fourth princess cut diamond 148. Diamonds 142, 144 are preferably located on one side of the central axis-Z and diamonds 146, 148 are preferably located on the other side of the axis-Z. Diamonds 142, 146 are preferably located on one side of an axis-Q and diamonds 144, 148 are preferably located on the other side of the axis-Q. The axis-Q is substantially perpendicular to the axis-Z.

Indentation 140 also includes a first larger round diamond 150, a second larger round diamond 152, a third larger round diamond 154, a fourth larger round diamond 156, a fifth larger round diamond 158 and a sixth larger round diamond 160. The first larger round diamond. 150 is positioned in juxtaposition with first princess diamond 142. The second larger round diamond 152 is positioned in juxtaposition with second princess diamond 144. The third larger round diamond 154 is positioned in juxtaposition with diamonds 150, 152 and preferably positions over an upper apex portion of Marquise shaped indentation 140. The fourth larger round diamond 156 is positioned in juxtaposition with third princess cut diamond 146. The fifth larger round diamond 158 is positioned in juxtaposition with fourth princess cut diamond 148. The sixth larger round diamond 160 is positioned in juxtaposition with diamonds 156, 158 and preferably positions over a lower apex portion of indentation 140.

Indentation 140 includes a first smaller round diamond 162, a second smaller round diamond 164, a third smaller round diamond 166, a fourth smaller round diamond 168, a fifth smaller round diamond 170 and a sixth smaller round diamond 172. The first smaller round diamond 162 is preferably positioned between the larger round diamonds 152, 154. The second smaller round diamond 164 is preferably positioned between the larger round diamonds 150, 154. The third smaller round diamond 166 is preferably positioned between the larger round diamonds 150, 152. The fourth smaller round diamond 168 is preferably positioned between the larger round diamonds 158, 160. The fifth smaller round diamond 170 is preferably positioned between larger round diamonds 156, 160. The sixth smaller round diamond 172 is preferably positioned between larger round diamonds 156, 158.

The juxtaposition arrangement of princess cut diamonds 142-148, larger round diamonds 150-160 and smaller round diamonds 162-172 altogether from a clustered composite head that creates an illusion of a big marquise shaped Diamond to the normal observer.

Figure 7:
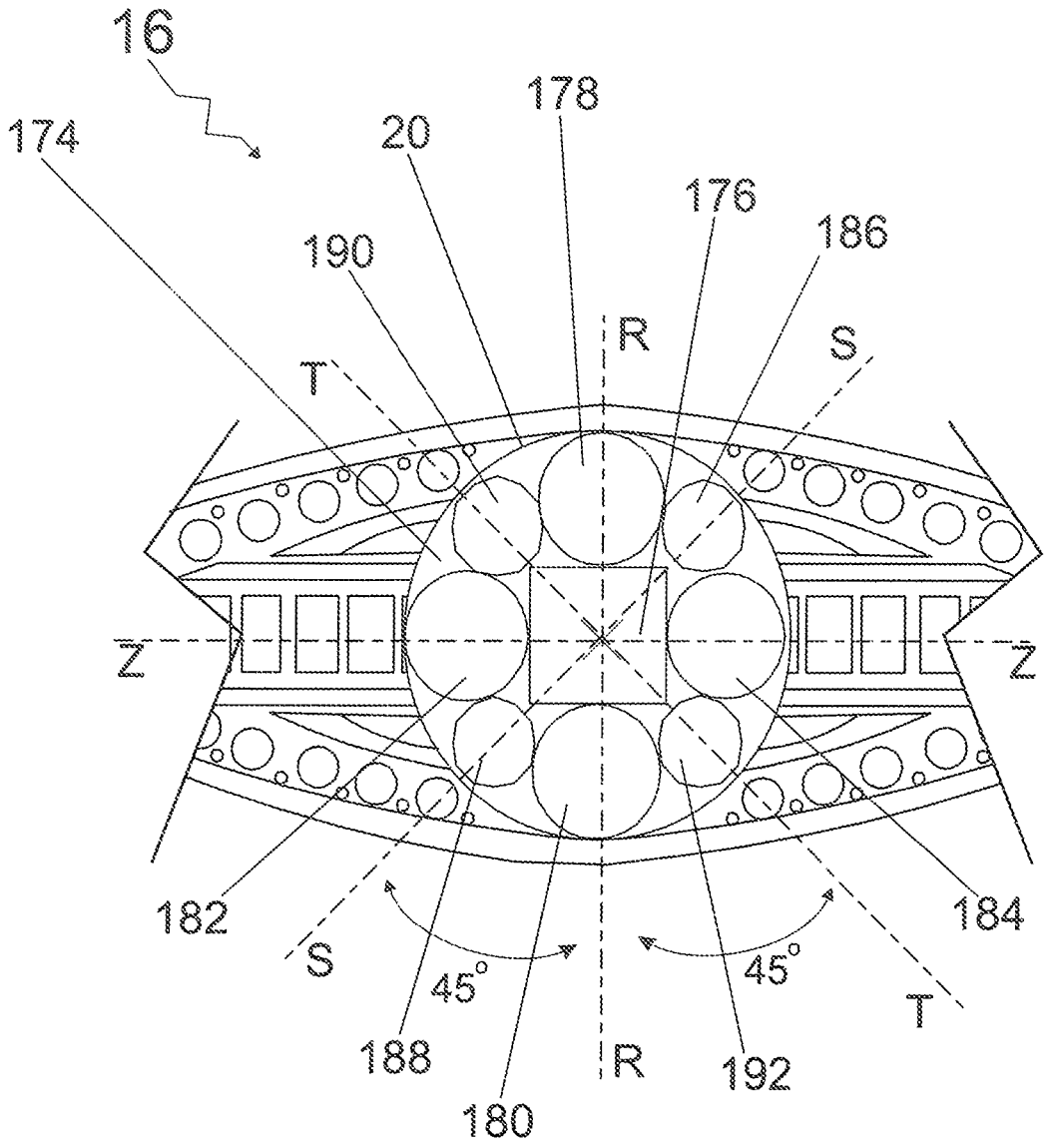
FIG. 7 is an enlarged top view of the head portion of the ring setting of FIG. 1 showing an alternative embodiment of the channel structure.

Referring to FIG. 7, an alternative embodiment of head section 16 is shown wherein the first channel structure 20 of head portion 16 is of circular shape and includes a circular shaped indentation 174 that is configured to include a plurality of small round cut, large round cut and princess cut diamonds/stones in a perfectly flush arrangement through an invisible setting means. The invisible setting means mounts diamonds/stones within indentation 174 by remaining invisible to a normal observer. The invisible setting is a metal structure concealed underneath the stones/diamonds to facilitate the diamonds/stones to have juxtaposition with each other and appear as a continuous, uninterrupted surface. The invisible setting means in this one preferred embodiment is preferably a channel setting, however, it is understood that other well-known invisible settings in the art also can be used in other alternative embodiments of ring 10.

Indentation 174 includes a princess cut diamond 176 that is preferably centrally positioned along the structure 20 such that diamond 176 has a center located along the central horizontal axis-Z. The princess cut diamond 176 is surrounded by a plurality of small round cut and large round cut diamonds. In this one preferred embodiment the indentation 20 is positioned with four large round diamonds 178, 180, 182, 184 and four small round diamonds 186, 188, 190, 192. However, it is understood that the quantity and size of small and large round cut diamonds may vary substantially in other alternative embodiments. The large round cut diamonds 178, 180 have their centers located along a single axis-R that is substantially perpendicular to the axis-Z. The large round cut diamonds 182, 184 have their centers located along the central horizontal axis-Z. The small round cut diamond 186 is positioned between two large cut diamonds 178, 184. The small round cut diamond 188 is positioned between two large cut diamonds 180, 182. The small round cut diamonds 186, 188 have their centers located along a single axis-S that makes an angle of 45 degree with central axis-Z. The small round cut diamond 190 is positioned between two large cut diamonds 178, 182. The small round cut diamond 192 is positioned between two large cut diamonds 180, 184. The small round cut diamonds 190, 192 have their centers located along a single axis-T that makes an angle of 45 degree with central axis-Z.

The juxtaposition arrangement of larger round cut diamonds 178-184, smaller round cut diamonds 186-192 and princess cut diamond 176 altogether form a clustered composite head that creates an illusion of a big round shaped Diamond to the normal observer.

Figure 8:
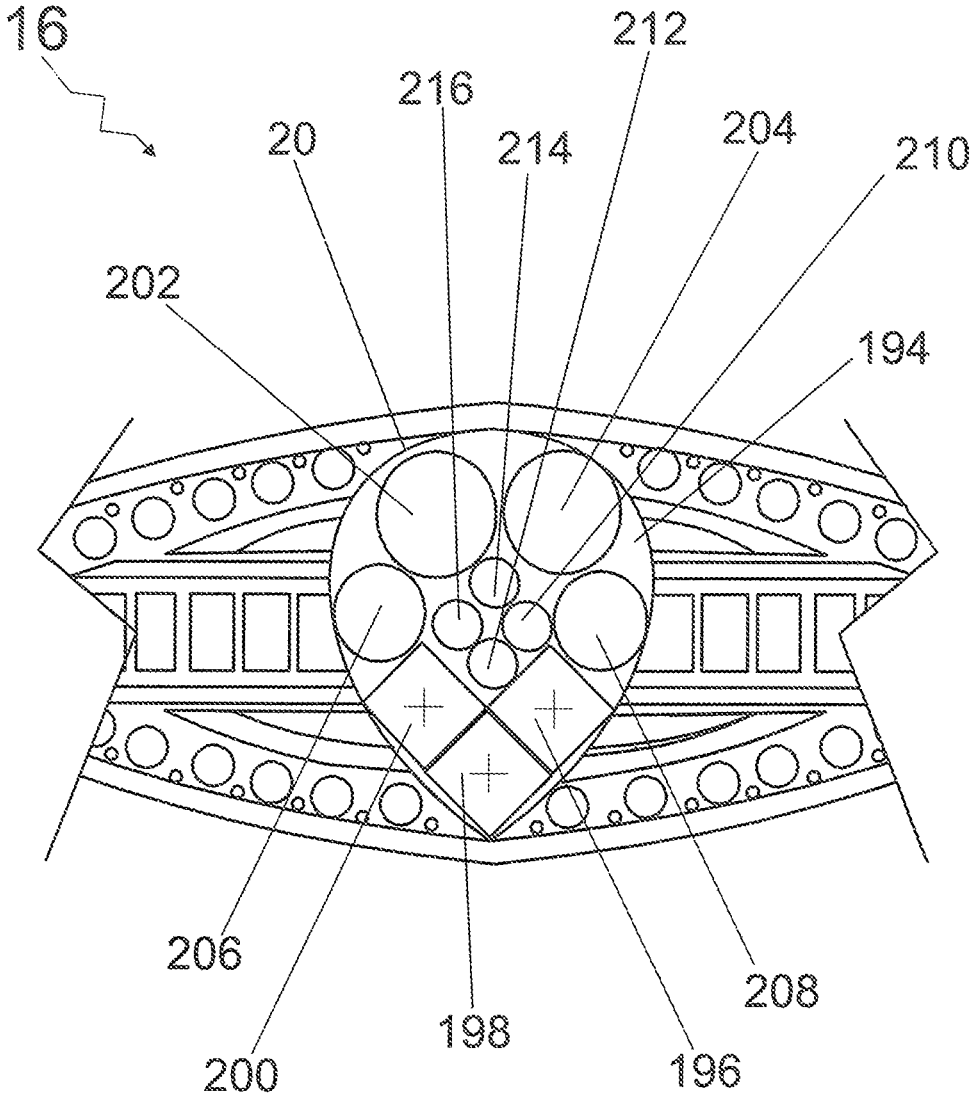
FIG. 8 is an enlarged top view of the head portion of the ring setting of FIG. 1 showing an alternative embodiment of the channel structure

Referring to FIG. 8, an alternative embodiment of head 16 is shown wherein channel structure 20 has a pear shaped indentation adapted to be positioned with a plurality of round cut and princess cut diamonds to form a composite Diamond Head cluster adapted to create an illusion of a big pear shaped diamond. In this one embodiment the structure 20 has a pear shaped indentation 194 that includes a first princess cut diamond 196, a second princess cut diamond 198, a third princess cut diamond 200, a first large round cut diamond 202, a second large round cut diamond 204, a first medium round cut diamond 206, a second medium round cut diamond 208, a first small round cut diamond 210, a second small round cut diamond 212, a third small round cut diamond 214 and a fourth small round cut diamond 216.

The princess cut diamonds 196-200, large round cut diamonds 202-204, medium round cut diamonds 206-208, and small round cut diamonds 210-216 are positioned to have juxtaposition arrangement to form a clustered composite head that creates an illusion of a big pear shaped Diamond to the normal observer. However, it is understood here that number and dimensions of the princess cut diamond may vary in other alternative embodiments.

Figure 9:
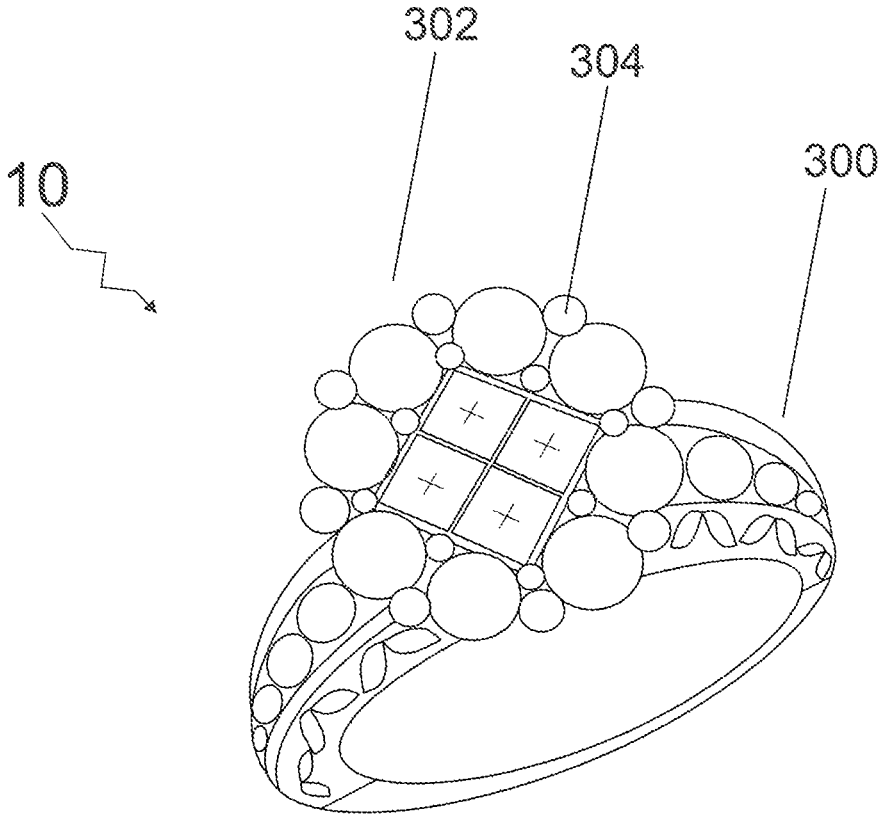
FIG. 9 is a prospective view of a first ring with a multiple stone setting.
Figure 10:
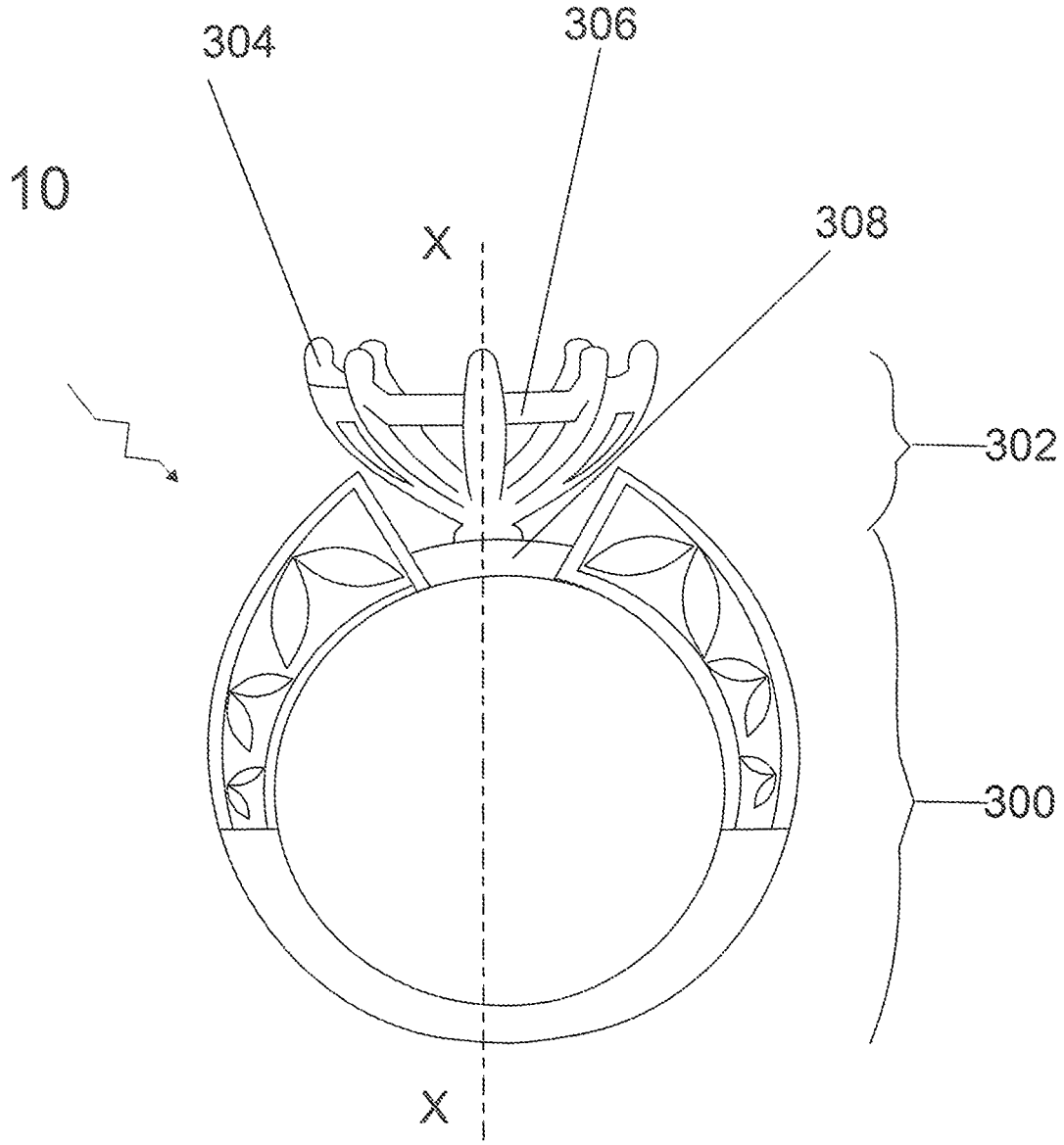
FIG. 10 is a side view of the ring of FIG. 9 without stones.
Figure 11:
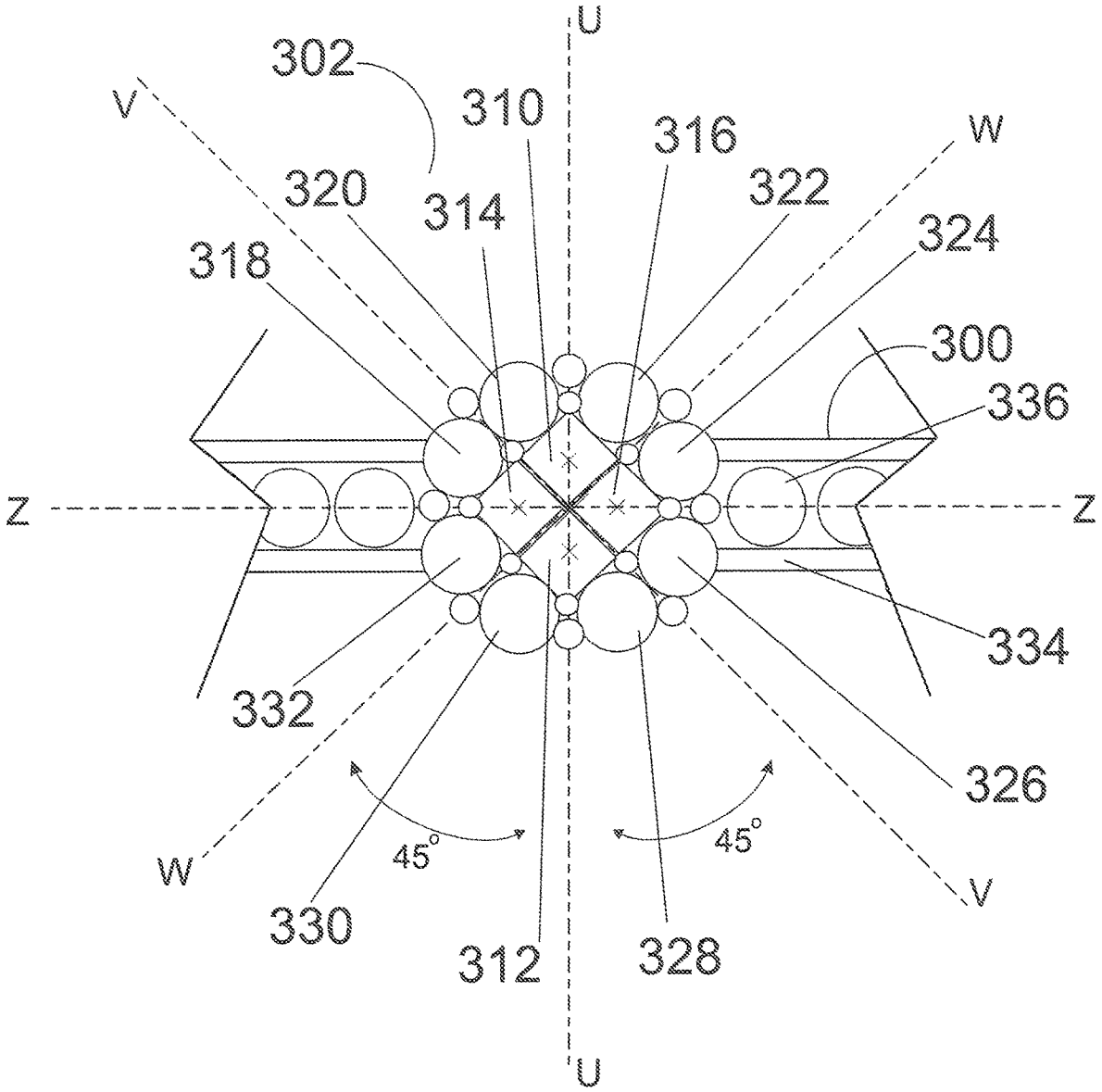
FIG. 11 is a top view of the ring of FIG. 9.

FIGS. 9-11 show a ring 10 having a ring body 300 and a setting 302 with stones 310, 312, 314, 316, 318, 320, 322, 324, 326, 328, 330, 332. The setting 302 has a mixture of prongs 304 mounted to one another other with bars 306. The mixture of prongs includes eight outer prongs and eight inner prongs. In some implementations, the outer prongs can be larger than the inner prongs. The inner and outer prongs set eight round-cut stones 318, 320, 322, 324, 326, 328, 330, 332. Specifically, each round-cut stone 318, 320, 322, 324, 326, 328, 330, 332 is set by two outer prongs and two inner prongs. The inner prongs also partially set four princess-cut stones 310, 312, 314, 316. That is, the four princess stones 310, 312, 314, 316 can be set next to one another to form a square. The square of stones 310, 312, 314, 316 is set with the inner prongs setting the outer circumference of the square while the center of the square can be set using an invisible setting. In some implementations, the setting, 302 can be mounted to the ring body 300 on an upper section 308 of the body 300. The body 300 can be adorned with additional stones and or design features.

Figure 12:
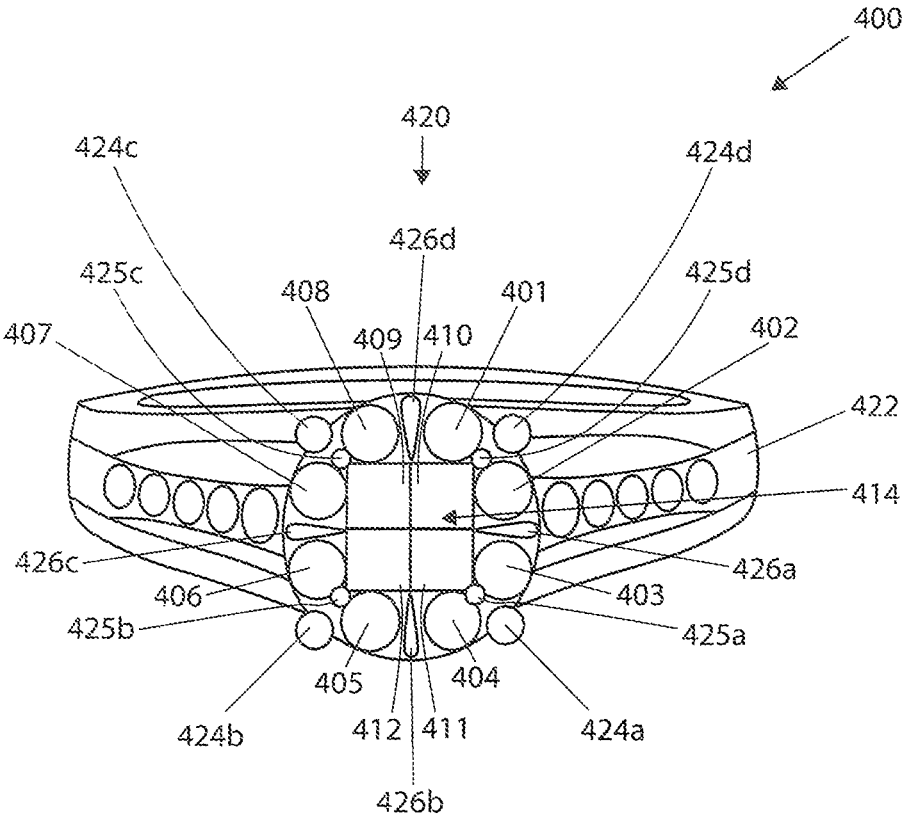
FIG. 12 is a prospective view of a second ring with a multiple stone setting.
Figure 13A:
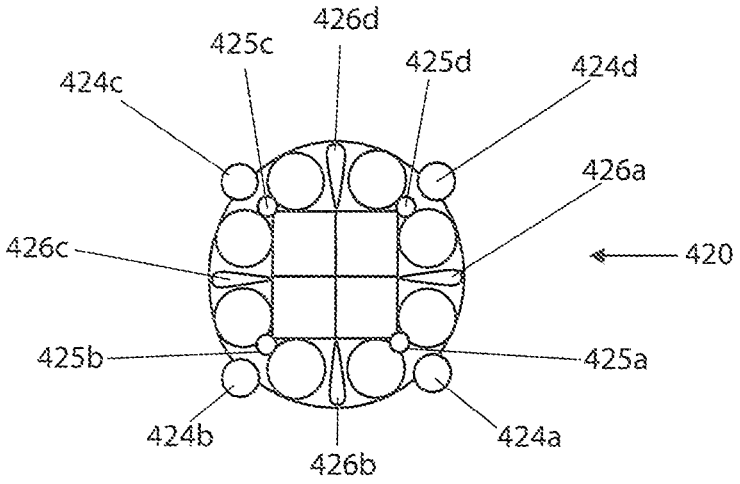
FIG. 13*a* is a top view of the ring of FIG. 12.
Figure 13B:
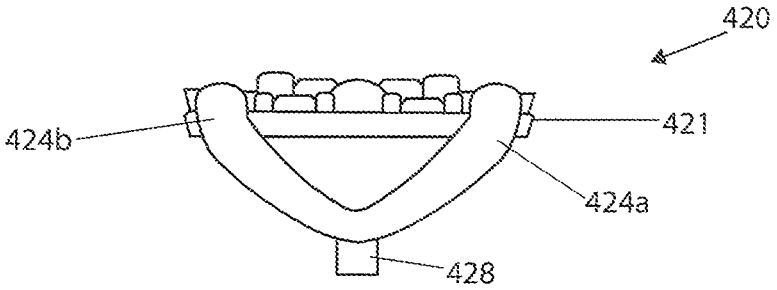
FIG. 13*b* is a side view of the ring of FIG. 12.
Figure 13C:
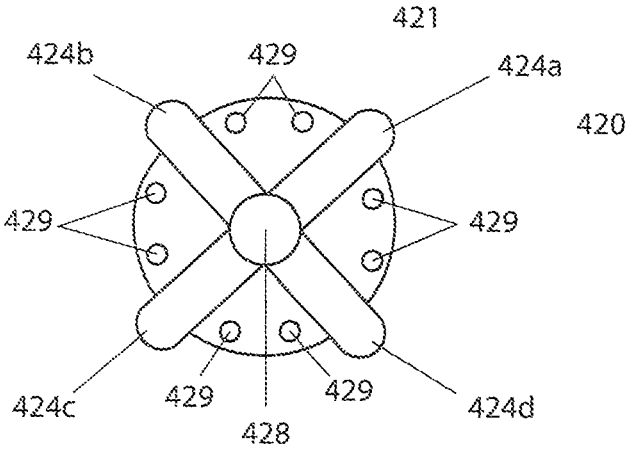
FIG. 13*c* is a bottom view of the ring of FIG. 12.
Figure 14:
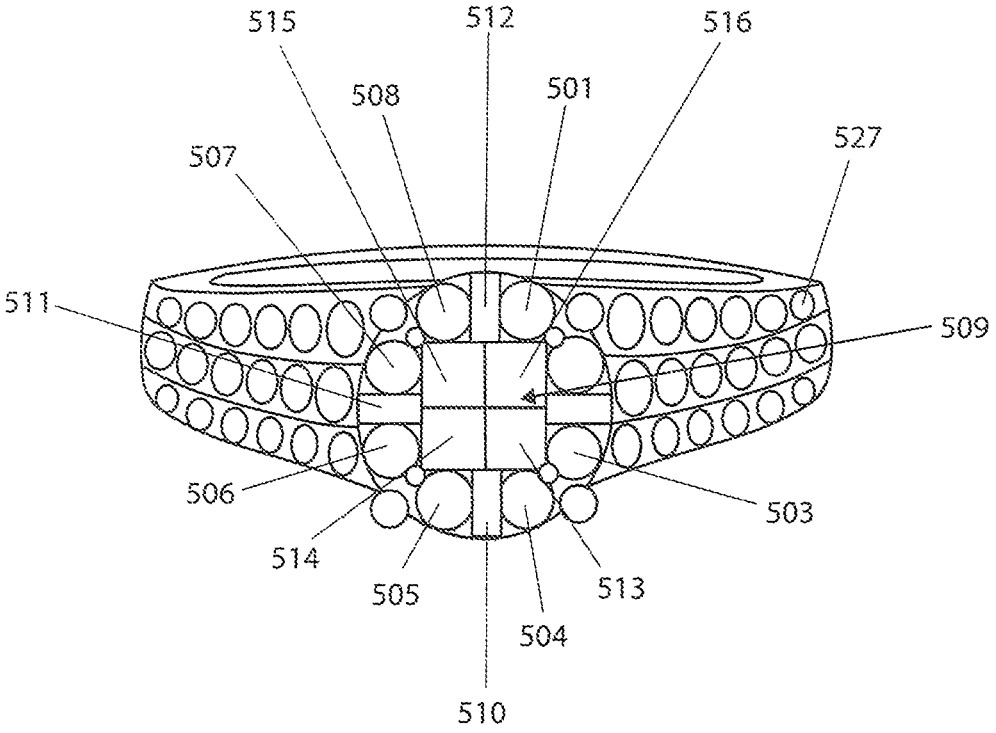
FIG. 14 is a prospective view of a third ring with a multiple stone setting.
Figure 15A:
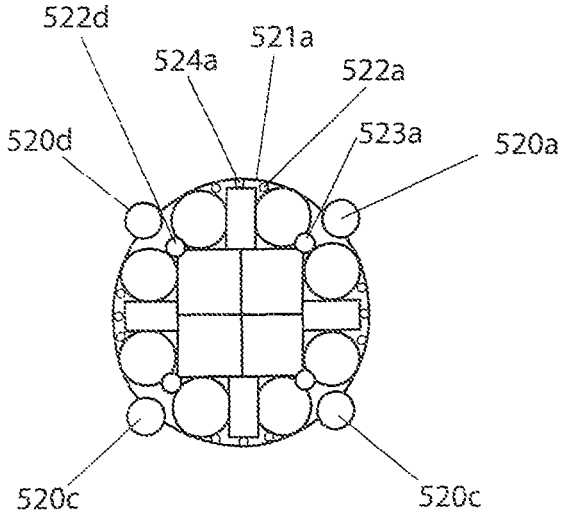
FIG. 15*a* is a top view of the ring of FIG. 14.
Figure 15B:
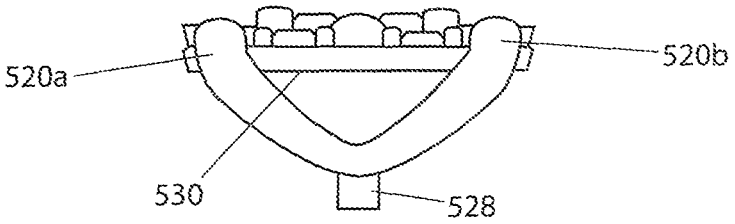
FIG. 15*b* is a side view of the ring of FIG. 14.
Figure 15C:
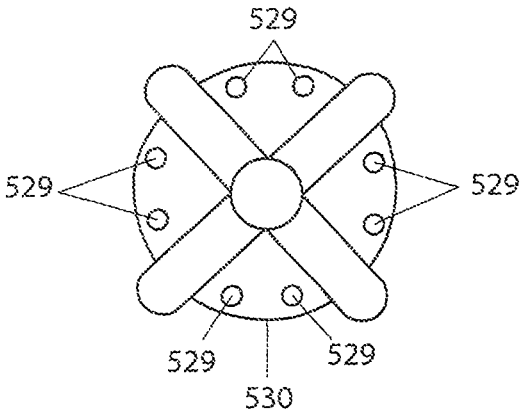
FIG. 15*c* is a bottom view of the ring of FIG. 14.
Figure 16:
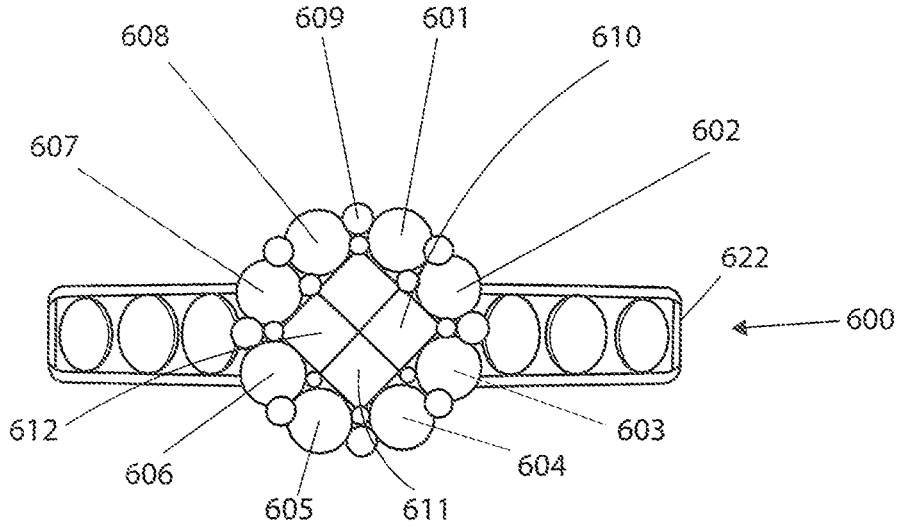
FIG. 16 is a prospective view of a fourth ring with a multiple stone setting.
Figure 17A:
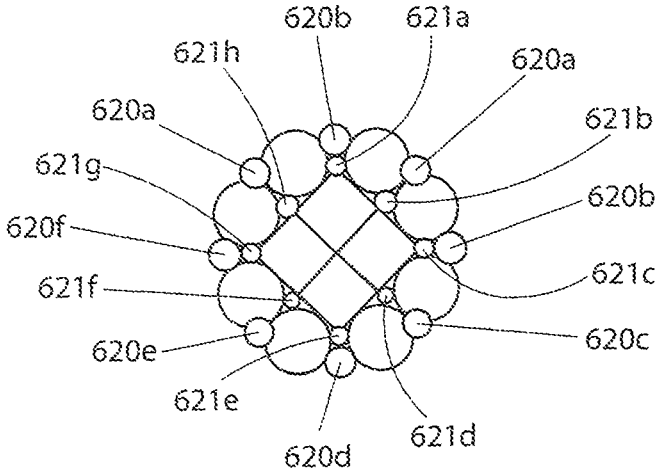
FIG. 17*a* is a top view of the ring of FIG. 16.
Figure 17B:
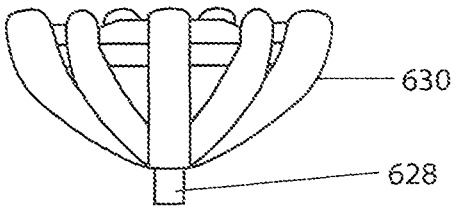
FIG. 17*b* is a side view of the ring of FIG. 16.
Figure 17C:
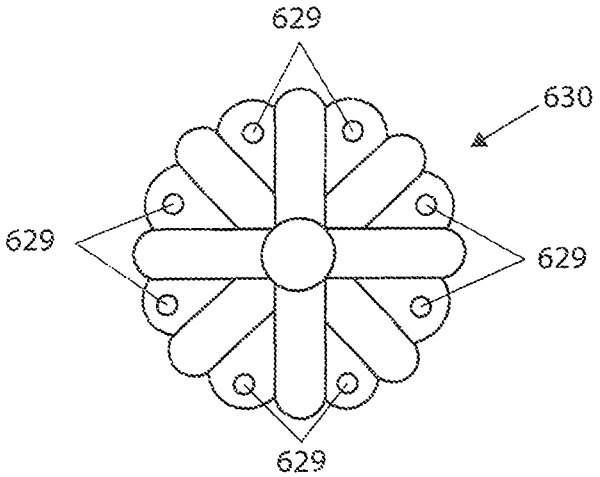
FIG. 17*c* is a bottom view of the ring of FIG. 16.
Figure 18:
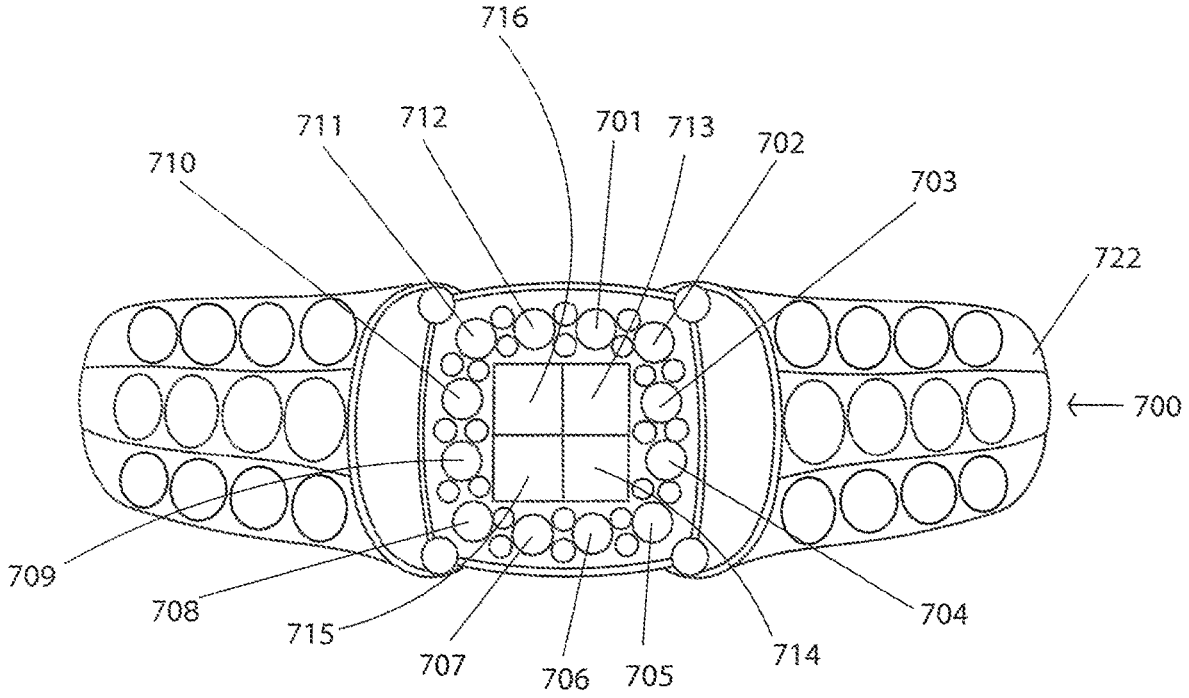
FIG. 18 is a prospective view of a fifth ring with a multiple stone setting.
Figure 19A:
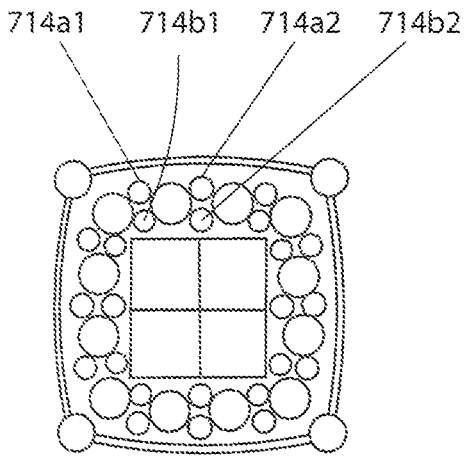
FIG. 19*a* is a top view of the ring of FIG. 18.
Figure 19B:
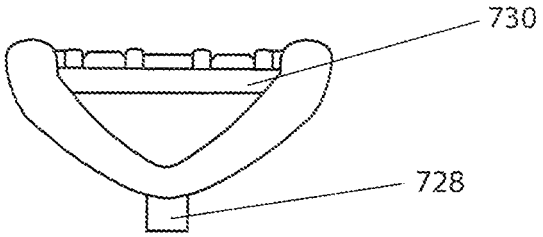
FIG. 19*b* is a side view of the ring of FIG. 18.
Figure 19C:
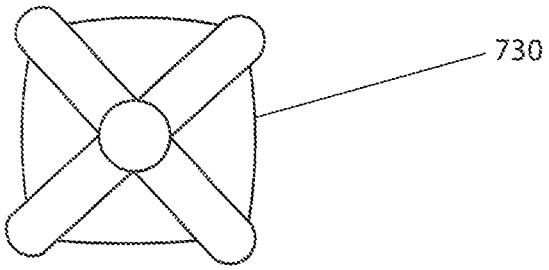
FIG. 19*c* is a bottom view of the ring of FIG. 18.
Figure 20:
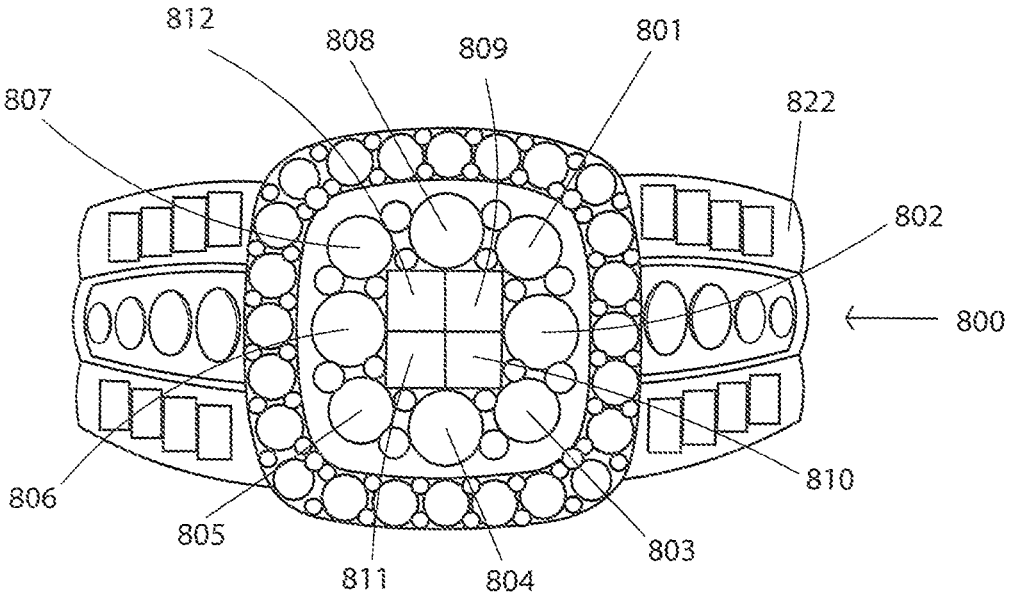
FIG. 20 is a prospective view of a sixth ring with a multiple stone setting.
Figure 21A:
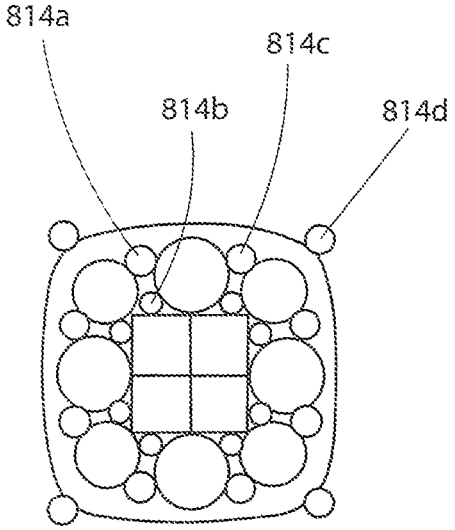
FIG. 21*a* is a top view of the ring of FIG. 20.
Figure 21B:
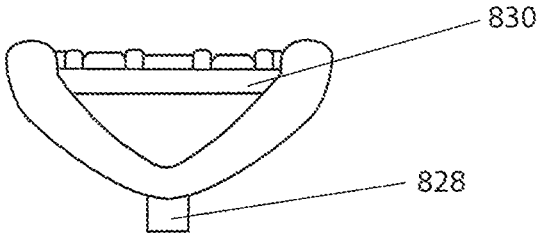
FIG. 21*b* is a side view of the ring of FIG. 20.
Figure 21C:
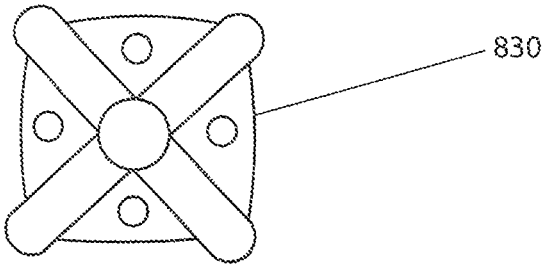
FIG. 21*c* is a bottom view of the ring of FIG. 2.0.

FIGS. 12-13*c* show a ring 400 having eight round-cut stones 401-408 and four princess-cut stones 409-412 in a single setting 420. The setting 420 includes a platform 421 with a mixture of prongs, e.g., four outer prongs 424*a-d*, torn inner prongs 425*a-d* and tear drop prongs 426*a-d*. The tear drop prongs 426*a-d* can extend from an outer circumference of the platform to an inner part of the setting. The four outer prongs 424*a-d* extend downwards past the platform 421 and form a mounting stem 428.

Each of the round-cut stones 401-408 can be placed in a mounting aperture 429 located on the platform 421. The round-cut stones 401-408 can then be set with a mixture of prongs, e.g., a single round-cut prong 401 can be set with an outer prong 424*a*, an inner prong 425*a* and a tear drop prong 426*a*. Additionally, the four princess stones 409-412 can be set next to one another to form a square 414. The square of stones 414 can be held in place by a combination setting that includes the inner prongs 425*a-d* setting the corners of the square 414, the tear drop prongs 426*a-d* setting the midpoint of the outer circumference of the square 414 while the center of the square can be set using, an invisible setting. As show in FIG. 13*b*, the mounting stem 428 mounts the setting to body 422. The body 422 can be adorned with additional stones and/or design features.

FIG. 14 and FIGS. 15*a-c* shows a ring having eight round-cut stones 501-508, four emerald-cut stones 509-512 and four princess-cut stones 513-536 in a single setting mounted to a platform 530. Each of the round cut stones 501-508 can be placed in a mounting aperture 529 located on the platform 521. The round-cut stones 501-508 can then be can be set with large prongs 520*a-d* and three small prongs 521, 522, 523. The large prongs 520*a-d* can be shared with an adjacent stone 509-512 as well as corners of the princess-cut stones 513-516. That is, the outer free corner of each princess-cut stone with can be set with prongs 523*a-d* while the remaining portions of the princess cut stones 513-516 can be set using an invisible setting. The emerald-cut stones 509-512 can be set with a small prong 542*a-d* along a front portion of the stone with respect to the circumference of the setting and set with two small prongs shared with adjacent stones. As show in FIG. 15*b*, the mounting stem 528 mounts the setting to body 527. The body 527 can be adorned with additional stones and/or design features, FIGS. 16 and 17*a-c* show a ring 600 having eight round-cut stones 601-608 and four princess-cut stones 609-612 in a single setting set on platform 630. Each of the round cut stones can be placed in a mounting aperture 629 located on the platform 621. The round-cut stones 601-608 can then be set with two large prongs 520*a-h* and two small prongs 521*a-h*. The outer free corner of each princess-cut stone 609-612 can be set with the small prongs 521*a-h*, the two other outer corners are set with a small prong and the center corners are set using an invisible setting. As show in FIG. 17*b*, the mounting stem 628 mounts the setting to body 622. The body 622 can be adorned with additional stones and/or design features.

FIGS. 18 and 19*a-c* show a ring 700 having twelve round-cut stones 701-712 and Thur princess-cut stones 713-716 in a single setting set on platform 730. Each of the round cut stones 701-712 can be placed in a mounting aperture 729 located on the platform 721. The round-cut stones 401-408 can then be set with four small prongs $714a_{1\text{-}12}$-$7b_{1\text{-}12}$. Each of the princess-cut stone are set a combination of prongs $7b_{1\text{-}12}$ and an invisible setting. As show in FIG. 19*b*, the mounting stem 728 mounts the setting to body 722. The body 722 can be adorned with additional stones and/or design features.

FIGS. 20 and 21*a-c* show a ring 800 having eight round-cut stones 801-808 and four princess-cut stones 809-812 in a single setting set on a platform 830. The round-cut stones 801-808 can be placed in a mounting aperture 829 located on the platform 821. The round-cut stones 401-408 can then be set using four prongs 814*a-p*. The princess-cut stones 801-

808 can be set adjacent to one another to form a square and the corners of the square can be set using four small prongs. The outer five corner of each princess-cut stone is set with the small prong and the remainder of the princess-cut stones are set using an invisible setting. As show in FIG. 21*b*, the mounting stem 828 mounts the setting to body 822. The body 782 can be adorned with additional stones and/or design features.

In the above implementations, the stones are set in such a way as to increase the fire, scintillation and brilliance of the stones by allowing light to enter each individual stone and be directed into and out of adjacent stones. Therefore, more light can be directed out of the stones as a cluster than they would individually. This enhancement in light also allows a viewer to see the stones as a single large stone as the light impedes the view of any separation between the stones. Furthermore, the placement of the prongs further directs light to the viewer enhancing this larger stone appearance. This combination also allows the cluster of stones to appear as a continuous, uninterrupted surface thereby creating an illusion of a large karat stone with high-quality brilliance and clarity.

The foregoing Detailed Description is to be understood as being in every respect illustrative, but not restrictive, and the scope of the disclosed technology disclosed herein is riot to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A ring comprising:

a platform, the platform includes a plurality of prongs and an invisible setting, the plurality of prongs including eight outer prongs and eight inner prongs, the eight outer prongs extending downwards past the platform being connected to one another forming a mounting stem;

a ring body, the mounting stem mounting the platform to the ring body;

at least eight round-cut stones, the at least eight round-cut stones being set on the platform using the plurality of prongs with each of the round-cut stones being set with two of the eight outer prongs and two of the eight inner prongs; and four princess-cut stones, each of the four princess-cut stones being set on the platform using at least two of the eight inner prongs and the invisible setting, wherein the eight outer prongs and the mounting stem raise the platform above the ring body in such a way as to increase the fire, scintillation and brilliance of the stones by allowing light to enter each individual stone and be directed into and out of adjacent stones.

* * * * *